US007798538B2

(12) United States Patent
Powell et al.

(10) Patent No.: US 7,798,538 B2
(45) Date of Patent: Sep. 21, 2010

(54) ELECTRICALLY CONTROLLABLE LATCH MECHANISM

(75) Inventors: Simon Powell, Royston (GB); Allan Robert Boutall, Hoddesden (GB)

(73) Assignee: PBT (IP) Limited, Essex (GB)

( * ) Notice: Subject to any disclaimer, the term of this patent is extended or adjusted under 35 U.S.C. 154(b) by 453 days.

(21) Appl. No.: 10/544,588

(22) PCT Filed: Feb. 25, 2004

(86) PCT No.: PCT/GB2004/000729

§ 371 (c)(1),
(2), (4) Date: Apr. 18, 2006

(87) PCT Pub. No.: WO2004/077473

PCT Pub. Date: Sep. 10, 2004

(65) Prior Publication Data

US 2006/0214434 A1 Sep. 28, 2006

(30) Foreign Application Priority Data

Feb. 28, 2003 (GB) ..... 0304671.1

(51) Int. Cl.
*E05C 1/06* (2006.01)

(52) U.S. Cl. ..... 292/144; 292/251.5

(58) Field of Classification Search ..... 292/144, 292/251.5, 71, 163, DIG. 66
See application file for complete search history.

(56) References Cited

U.S. PATENT DOCUMENTS 3,799,591 A * 3/1974 Taniyama ..... 292/71
4,056,276 A * 11/1977 Jarvis ..... 292/201
4,727,301 A * 2/1988 Fulks et al. ..... 318/468
5,343,179 A * 8/1994 Pipich et al. ..... 335/167
5,512,720 A * 4/1996 Coudert et al. ..... 200/400
5,629,662 A * 5/1997 Floyd et al. ..... 337/36
5,649,726 A * 7/1997 Rogers et al. ..... 292/201
5,690,371 A * 11/1997 Turnbull ..... 292/163
5,964,487 A * 10/1999 Shamblin ..... 292/144
6,008,992 A * 12/1999 Kawakami ..... 361/726
6,009,732 A * 1/2000 Haeck et al. ..... 70/92
6,211,758 B1 * 4/2001 Castonguay et al. ..... 335/202
6,527,310 B1 * 3/2003 Bellamy ..... 292/144
6,641,183 B2 * 11/2003 Brown ..... 292/92
6,972,659 B2 * 12/2005 von Behrens et al. ..... 337/139
2004/0104580 A1 * 6/2004 Spiessl et al. ..... 292/84
2005/0046200 A1 * 3/2005 Dominique ..... 292/216

* cited by examiner

*Primary Examiner*—Peter M Cuomo
*Assistant Examiner*—Kristina R Fulton
(74) *Attorney, Agent, or Firm*—Renner, Kenner, Greive, Bobak, Taylor & Weber

(57) ABSTRACT

A latch mechanism comprises a housing (11), a plunger (12) mounted for reciprocation in the housing, a pawl (17) mounted with the housing for movement into and out of engagement with the plunger (12) and means for moving the pawl, wherein the means for moving the pawl comprises an electrically controlled piezo ceramic actuator (30) located within the plunger (12) and the pawl (17) is provided with a part (24) projecting into the plunger (12) and arranged to be contacted by the actuator (30) in order to control operation of the mechanism.

6 Claims, 2 Drawing Sheets

ELECTRICALLY CONTROLLABLE LATCH MECHANISM

The present invention relates to an electrically controllable latch mechanism.

Latch mechanisms are well known arrangements and often take the form of a housing which retains a latching member capable of reciprocation in a direction into and out of the housing. Such mechanisms have many uses and are often mechanically controlled. Electrical control of such mechanisms is also known but often the electrical control arrangements are too bulky or expensive.

For example, patent publication, EP-A-0682354, describes a circuit breaker mechanism wherein a spring plunger, which is coupled to a bell crank arrangement, is released by a solenoid causing an actuator to interact with a contact breaking mechanism.

It is an object of the present invention to provide an electrically controllable latch mechanism which is inexpensive to produce, occupies little space and is reliable in operation.

Accordingly, the present invention provides a latch mechanism comprising a housing, a plunger mounted for reciprocation in the housing and having a portion which, in one position of the plunger, is arranged to project from the housing, a pawl mounted within the housing for movement into and out of engagement with the plunger and means for moving the pawl, wherein the means for moving the pawl comprises an electrically controlled actuator located within the plunger and the pawl is provided with a part projecting into the plunger and arranged to be contacted by the actuator in order to control movement of the plunger, and wherein when the actuator is not in contact with the part projecting into the plunger, the plunger is capable of reciprocation in the housing.

Preferably, the pawl is in the form of a bell crank lever, one arm of which forms the part projecting into the plunger and the other arm being arranged to abut a surface of the plunger to inhibit movement of the plunger.

In a preferred embodiment, the pawl is biased to a position where the other arm is prevented from abutting the surface of the plunger.

Alternatively, it may be that the pawl is biased to a position where the other arm is abutting the surface of the plunger when the actuator is in an unenergised state.

In order that the present invention be more readily understood, an embodiment thereof will now be described with reference to the accompanying drawings in which.

Figure 1:
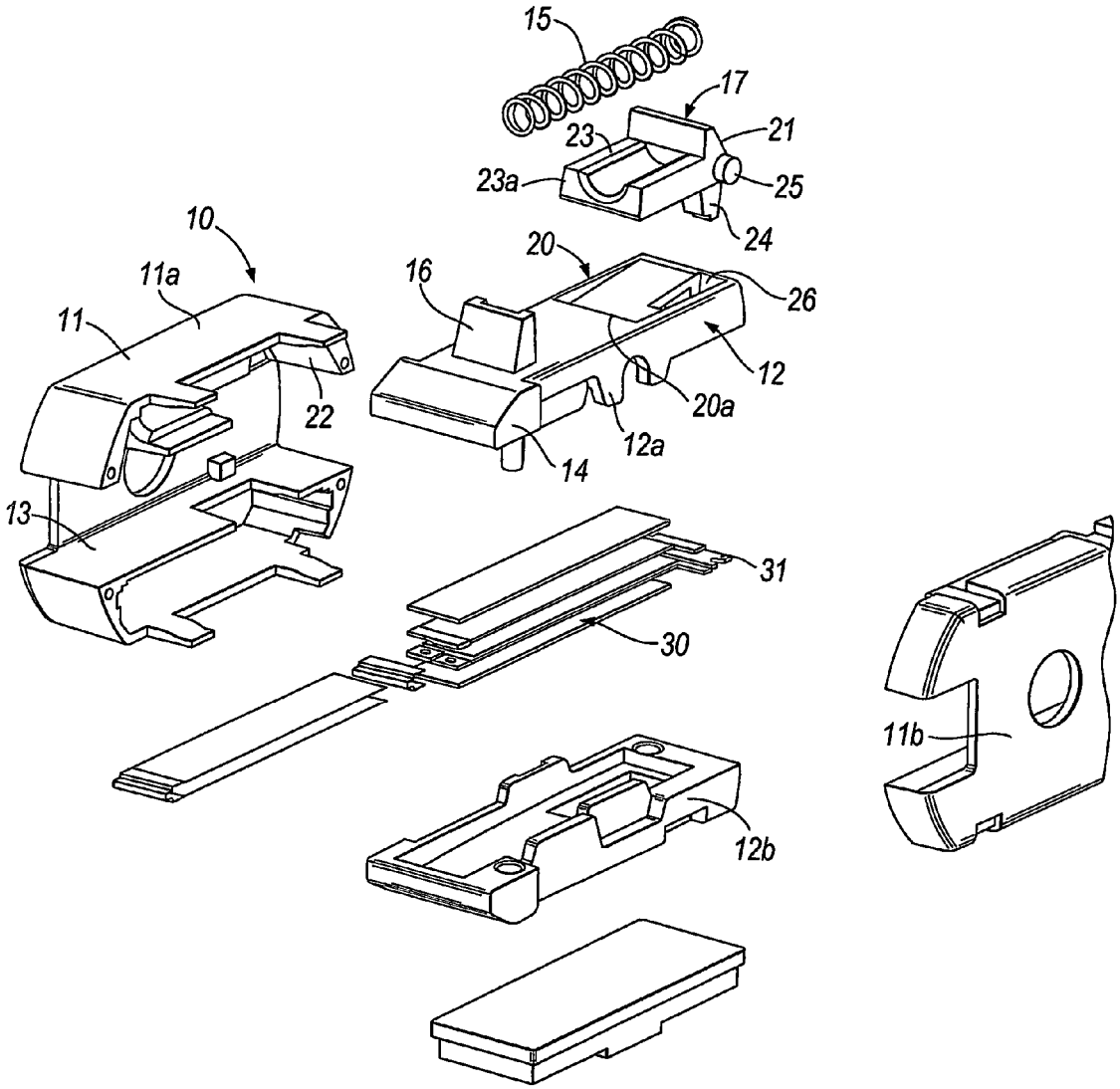
FIG. 1 shows an exploded perspective view of an embodiment of the present invention.

A preferred form of latch mechanism is shown in the accompanying drawings and indicated by the reference numeral 10. It comprises a housing 11 formed by housing parts 11*a* and 11*b*. The housing receives a latch member 12 in such a fashion that the member 12 can reciprocate in a direction into and out of the housing 11 in a channel 13. The moveable member 12 is provided with an extension 14 which projects, in operation, out of the housing and forms the active part of the mechanism.

In this example, the moveable member 12 is biased to the extended position with the portion 14 projecting out of the housing by means of a resilient member in the form of a coil spring 15, one end of which is received on a spring seat 16 provided on the moveable member 12 and the other end of which acts on the housing 11.

As described thus far, the moveable member 12 acts as a freely reciprocating plunger under the bias of the spring 15. However, in order to be useful, it is necessary to control the movement of the member 12 and in this case this control is such as to prevent the moveable member 12 being pushed into the housing against the action of the spring 15. This is achieved in a very simple fashion by means of a control member in the form of a pawl 17 which is best seen in FIG. 1. The control member is arranged to partly project into a shaped recess 20 in the moveable member 12.

Figure 2:
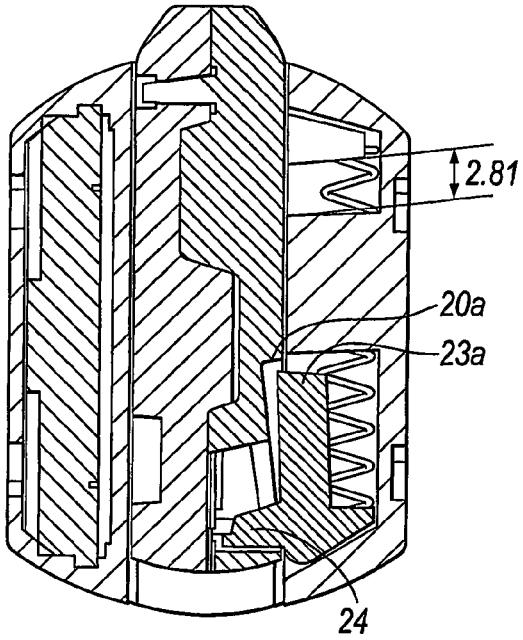
FIG. 2 shows a cross sectional view through the embodiment shown in FIG. 1.
Figure 3:
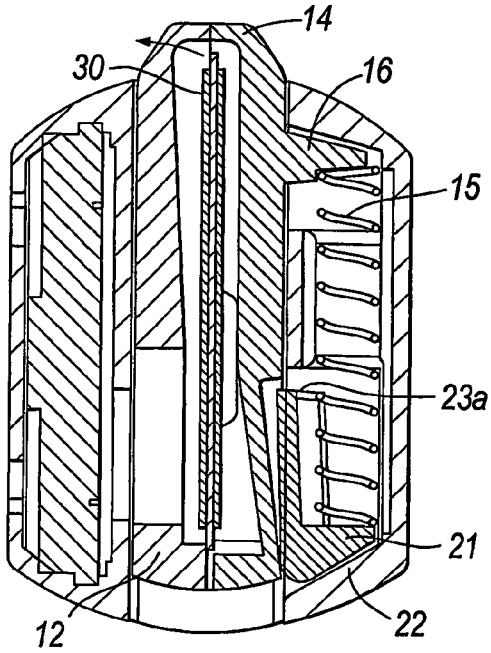
FIG. 3 shows a further cross sectional view through the embodiment of FIG. 1 at a different plane.

The construction of the pawl 17 is important and from a comparison of the pawl 17 as shown in FIGS. 1, 2 and 3, it will be noted that it is provided with an angled arm 21 which is arranged to abut an angled internal surface 22 of the housing. Additionally, the pawl 17 is formed with legs 23 and 24 which extend away from a pivot 25 at an angle with respect to each other in order to form a bell crank lever. The leg 24 is shaped and of a length to extend into an elongate through hole 26 in the shaped recess 20 while the leg 23 extends substantially across the width of the recess 20 so that the end 23*a* of the leg 23 can be rotated into and out of engagement with the end wall 20*a* of the recess 20. The pawl 17 is biased to a position where the end 23*a* of the leg 23 is out of engagement with the end wall 20*a* of the recess 20 by virtue of the spring 15 acting on the angled arm 21.

With the mechanical assembly described thus far, and in the absence of any force being applied to the leg 24 of the pawl 17, the member 12 is still free to move in a direction into and out of the housing 11 under the action of the bias spring 15 in the presence of a force acting on the extension 14 of the member 12. However, if a force is applied to the leg 24 sufficient to overcome the spring force of the spring 15, the leg 23 is rotated about the pivot 22 resting on the angled surface 22 of the housing 11 to bring the end 23*a* of the leg 23 into engagement with the end wall 20*a* of the recess 20. When this occurs, the member 12 is blocked and cannot move in a direction into the housing 11 since the member 17 is trapped between the end 20*a* of the recess 20 and the sloping surface 22 of the housing.

Once the applied force on the leg 24 is released, the spring force from the spring 15 rotates the bell crank lever and moves the leg 23 from its blocking position so as to release the member 12 for free reciprocation once more.

In the present embodiment, the force is applied to the leg 24 using a piezo ceramic actuator. Preferably, the member 12 is a hollow member made up of two parts indicated by the sections 12*a* and 12*b* in FIG. 1 and the piezo ceramic actuator indicated generally by the reference numeral 30 in FIG. 1 is received within the hollow member 12. For simplicity, the electrical connections to the piezo ceramic actuator are not shown and the construction of the actuator is also merely exemplary of any one of a number of suitable constructions which might be used. In any event, the actuator is provided with an actuation member 31 which is moved into and out of engagement with the end of the leg 24. In this embodiment, when the piezo electric actuator is energised, the portion 31 is moved to engage the leg 24 and as the member 12 tends to move into the housing, the leg 24 is rotated about the pivot 22 against the action of the spring 15 and thus the leg 23 is brought into blocking engagement with the end face 20*a* of the recess 20 in the moveable member 12. When de-energised, the portion 31 moves out of engagement with the end 24 and permits rotation of the bell crank lever under the action of the spring 15.

It will be appreciated that the above construction has many advantages among which are the fact that the mechanism cannot be burst by simply applying a great deal of force on the portion 14 in order to force the member 12 into the housing 11 due to the fact that movement of the member 12 is being prevented by the pawl 17 and not by the piezo ceramic actuator itself which is merely acting as a control element. Additionally, the arrangement is mechanically self adjusting since the pawl 17 is not fixed to the internal surface 22 on the housing and so can slide down the incline in order to maintain contact with the member 12 even if wear occurs.

Figure 4:
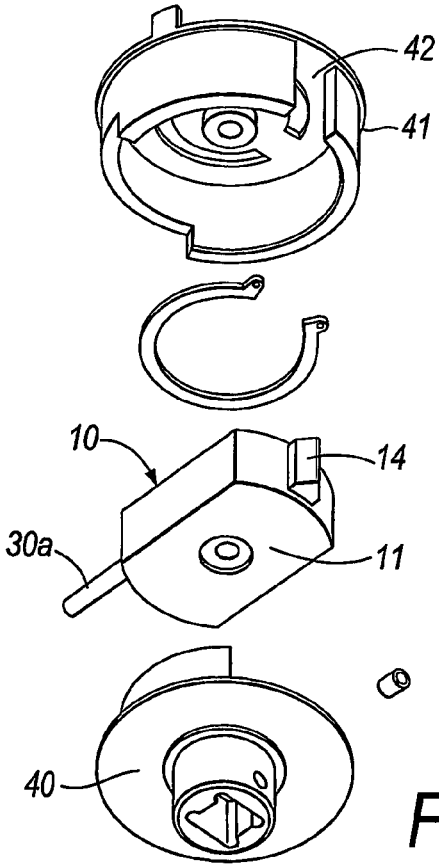
FIG. 4 shows an example of a use of the embodiment.

The above construction has many uses, one being as a part of an electrically controllable clutch member in a mechanical drive. This use is exemplified in FIG. 4 where the assembly 10 is fixed to a rotatable member 40 and selectively permits connection of the member 40 to a further rotatable member 41 by virtue of the extension 14 engaging in a slot 42 in order to transmit drive to the member 41 when the member 40 is rotated and vice versa. Also shown is the power input means 30*a* of the assembly 10. The power input means receives the necessary power to energise the electrically controlled actuator 30. Such a drive arrangement can conveniently be used in an electrically controlled door lock mechanism and it has low power consumption which means that it is suitable for battery powered operation.

The invention claimed is:

1. A latch mechanism comprising a housing, a plunger slidably mounted within the housing, the plunger defining an inner cavity with a through hole and having an extension end that will move into and out of the housing with respect to the movement of the plunger;

a pawl pivotally mounted between a sloping top surface of the plunger and an internal surface of the housing, the pawl comprises a first leg projecting into the inner cavity of the plunger and an opposed second leg that will contact the internal surface of the housing, the pawl is arranged to move between an engaged position, engaging the plunger to prevent movement of the plunger, and a disengaged position, allowing movement of the plunger;

means for biasing the plunger;

an electrically controlled actuator located entirely within the inner cavity of the plunger and having an actuator member;

wherein, when the actuator is energized, the actuator member is moved to contact the first leg of the pawl to pivotally move the pawl to the engaged position, and when the actuator is de-energized, the actuator moves out of engagement with the first leg of the pawl to allow movement of the plunger.

2. A latch mechanism according to claim 1, wherein the pawl is in the form of a bell crank lever.

3. A latch mechanism according to claim 2, wherein the pawl is biased to a position where the second leg is prevented from abutting the surface of the plunger.

4. A latch mechanism according to claim 1, wherein the plunger is biased to an extended position with the extension end projecting from the housing.

5. A latch mechanism according to claim 1, wherein the actuator is in the form of a piezo ceramic device.

6. A latch mechanism according to claim 1 wherein when the actuator is in contact with the pawl, the extension end of the plunger is prevented from slidable reciprocation into the housing irrespective of the direction of applied forces on the portion.

* * * * *

UNITED STATES PATENT AND TRADEMARK OFFICE

CERTIFICATE OF CORRECTION

PATENT NO. : 7,798,538 B2
APPLICATION NO. : 10/544588
DATED : September 21, 2010
INVENTOR(S) : Simon Powell and Allan Robert Boutall It is certified that error appears in the above-identified patent and that said Letters Patent is hereby corrected as shown below:

Column 4: Claim 6, line 5 - "portion" should be "extension end"

Signed and Sealed this

Thirtieth Day of November, 2010

David J. Kappos

David J. Kappos
*Director of the United States Patent and Trademark Office*